US007942691B1

(12) United States Patent
McSweyn

(10) Patent No.: US 7,942,691 B1
(45) Date of Patent: May 17, 2011

(54) UNIVERSAL SERIAL BUS CABLE (USB) CABLE ASSEMBLY HAVING PORTS TO SLIDABLY RECEIVE UPSTREAM AND DOWNSTREAM CONNECTORS

(75) Inventor: Christopher Michael McSweyn, Oxnard, CA (US)

(73) Assignee: Scosche Industries, Inc., Oxnard, CA (US)

( * ) Notice: Subject to any disclaimer, the term of this patent is extended or adjusted under 35 U.S.C. 154(b) by 0 days.

(21) Appl. No.: 12/723,562

(22) Filed: Mar. 12, 2010

(51) Int. Cl.
*H01R 13/72* (2006.01)

(52) U.S. Cl. ..... 439/501

(58) Field of Classification Search ..... 439/501, 439/528, 638; 361/752
See application file for complete search history.

(56) References Cited

U.S. PATENT DOCUMENTS 3,853,285 A * 12/1974 Woodring ..... 242/378.1
4,653,833 A * 3/1987 Czubernat et al. ..... 439/528
5,214,368 A * 5/1993 Wells ..... 320/105
7,077,693 B1 * 7/2006 Symons ..... 439/501
2006/0046561 A1 * 3/2006 Lam et al. ..... 439/501
2006/0160412 A1 * 7/2006 Symons ..... 439/501
2007/0020993 A1 * 1/2007 Symons ..... 439/501
2008/0133815 A1 * 6/2008 Mori ..... 710/313
2008/0143290 A1 * 6/2008 Chavakula ..... 320/101
2008/0239681 A1 * 10/2008 Iida ..... 361/752
2009/0156053 A1 * 6/2009 Hwang et al. ..... 439/501
2010/0052613 A1 * 3/2010 Leung et al. ..... 320/114

* cited by examiner

*Primary Examiner* — Chandrika Prasad
(74) *Attorney, Agent, or Firm* — Arent Fox LLP

(57) ABSTRACT

A Universal Serial Bus (USB) cable assembly for connecting a portable electronic device to a host device includes a USB cable, an upstream connector, a downstream connector connected to the upstream connector by the USB cable, and a main body section having an upstream connector port configured to slidably receive the upstream connector and a downstream connector port configured to slidably receive the downstream connector, wherein the USB cable is slidably secured to the main body section. In another aspect of the disclosure, the main body section of the USB cable assembly includes an attachment mechanism which is a through-hole formed in the main body section. In yet another aspect of the disclosure, a USB cable assembly includes an upstream connector, a first downstream connector, and a second downstream connector. A USB cable splits into a first downstream USB cable and a second downstream USB cable for connecting the upstream connector to the first and second downstream connectors.

23 Claims, 9 Drawing Sheets

UNIVERSAL SERIAL BUS CABLE (USB) CABLE ASSEMBLY HAVING PORTS TO SLIDABLY RECEIVE UPSTREAM AND DOWNSTREAM CONNECTORS

BACKGROUND

1. Field

The present disclosure relates to a portable Universal Serial Bus (USB) cable, and more particularly, to a compact and portable USB cable that can be configured as a keychain accessory.

2. Description of Related Art

USB cables are well-known in the art. However, there is a need for a more compact portable USB cable assembly that can be transported easily by a user, eliminates the tangle and hassle of loose wires, and is ergonomically and aesthetically pleasing to the user.

SUMMARY

In one aspect of the disclosure, a Universal Serial Bus (USB) cable assembly for connecting a portable electronic device to a host device includes a USB cable, an upstream connector, a downstream connector connected to the upstream connector by the USB cable, and a main body section having an upstream connector port configured to slidably receive the upstream connector and a downstream connector port configured to slidably receive the downstream connector, wherein the USB cable is slidably secured to the main body section.

In another aspect of the disclosure, the USB cable assembly comprises an attachment mechanism. The attachment mechanism may be a through-hole formed in the main body section.

In yet another aspect of the disclosure, a USB cable assembly includes an upstream connector section having a housing and an upstream connector secured to the housing, a downstream connector section having a first downstream housing, a first downstream connector secured to the first downstream housing, a second downstream housing, and a second downstream connector secured to the second housing, a main body section having an upstream connector port configured to slidably receive the upstream connector and a downstream connector port configured to slidably receive the first and second downstream housings, and a USB cable that joins the upstream connector section, the main body section, and the downstream connector section.

It is understood that other aspects of a USB cable assembly will become readily apparent to those skilled in the art from the following detailed description, wherein it is shown and described only exemplary configurations of a cable assembly. As will be realized, the invention includes other and different aspects of a cable assembly and the various details presented throughout this disclosure are capable of modification in various other respects, all without departing from the spirit and scope of the invention. Accordingly, the drawings and the detailed description are to be regarded as illustrative in nature and not as restrictive.

DETAILED DESCRIPTION

Figure 1:
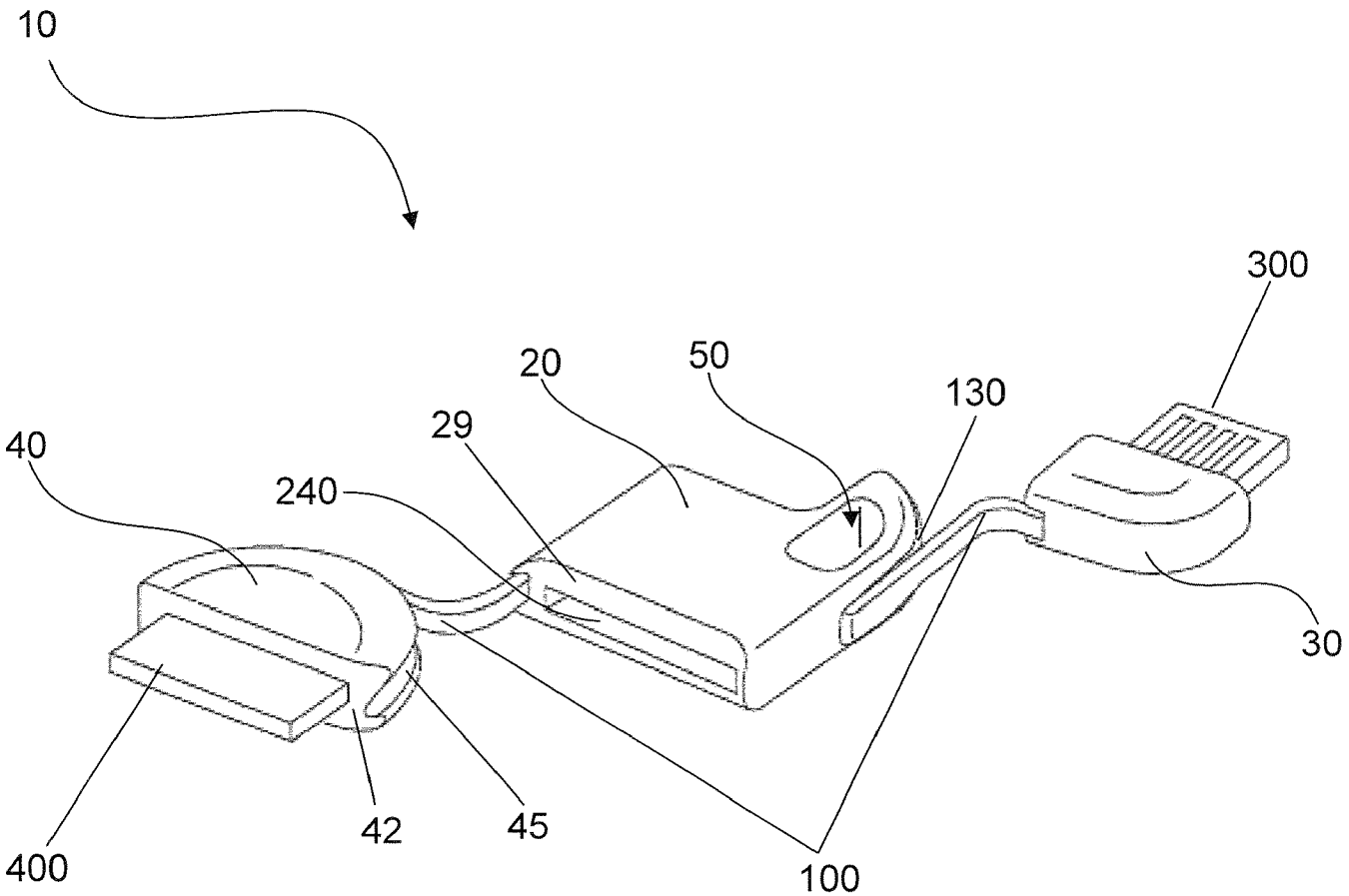
FIG. 1 is a perspective view of a USB cable assembly in a first configuration, in accordance with aspects of the present invention.

The present invention is described more fully hereinafter with reference to the accompanying drawings, in which various aspects of a compact and portable USB cable assembly are shown. This invention, however, may be embodied in many different forms and should not be construed as limited by the various aspects of the USB cable assembly presented herein. The detailed description of the USB cable assembly is provided below so that this disclosure will be thorough and complete, and will fully convey the scope of the present invention to those skilled in the art.

The detailed description may include specific details for illustrating various aspects of a USB cable assembly. However, it will be apparent to those skilled in the art that the invention may be practiced without these specific details. In some instances, well known elements may be shown in block diagram form, or omitted, to avoid obscuring the inventive concepts presented throughout this disclosure.

Various aspects of a USB cable assembly may be illustrated by describing components that are coupled, attached or connected together. As used herein, the terms "coupled", "attached", and "connected" may be used to indicate either a direct connection between two components or, where appropriate, an indirect connection to one another through intervening or intermediate components. In contrast, when a component is referred to as being "directly coupled", "directly attached" or "directly connected" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of a USB cable assembly in addition to the orientation depicted in the drawings. By way of example, if a USB cable assembly in the drawings is turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of a USB cable assembly may be illustrated with reference to one or more exemplary embodiments. As used herein, the term "exemplary" means "serving as an example, instance, or illustration," and should not necessarily be construed as preferred or advantageous over other embodiments of a USB cable assembly disclosed herein.

The USB cable assembly is compact and portable so that it can easily be stowed for transport, greatly enhancing a consumer's ability to use the USB cable assembly to recharge, power, and/or perform data transfer/synchronization for one or more portable electronic devices (PEDs) that rely on a USB port for power, recharging and/or data transfer. The USB cable assembly may be configured to provide one or more USB 5V connectors for connecting to one or more PEDs when plugged into a host device, which may be a personal computer, for example.

FIG. 1 provides a perspective view of a USB cable assembly 10 in accordance with aspects of the present invention. The USB cable assembly 10 is configured to connect a PED to a host device, such as a computer, for example. A USB cable 100 connects an upstream connector 300, which is preferably a male 4 pin Type A USB connector, to a downstream connector 400, which may be a 30 pin connector, for example, of the type typically used as a dock connector for an iPOD® or iPhone®. The USB cable 100 may be a shielded cable having two wires, a power and a ground wire, for delivering power at 5 volts from the host to the PED, and a braided pair of wires for carrying data between the host and the PED. In accordance with another aspect of the present invention, the USB cable assembly 10 may be provided with a suitable attachment mechanism, such as a screw eye or, as shown in FIGS. 1-4, a through-hole 50 formed in a main body section 20. The through-hole 50 may be used to attach the cable assembly 10 to a keychain, such as a wrist coil keychain, for example. In this manner, and due to its compact, lightweight and ergonomic design, the USB cable assembly 10 may be easily stored and/or transported for convenient access and efficient use.

As depicted in FIG. 1, the USB cable assembly 10 is in an operational configuration and includes a main body section 20, a detachable upstream connector body section 30, and a detachable downstream connector body section 40. The main body section 20 includes an upstream connector port 230 (see also FIG. 2) and a downstream connector port 240 for slidably receiving the upstream and downstream connectors, 300 and 400, respectively. In the operational configuration, the upstream and downstream connectors, 300 and 400, are disengaged from the respective upstream and downstream connector ports, 230 and 240, so that the upstream connector body section 30 and the downstream connector body section 40 may be separated from the main body section 20. The upstream connector body section 30 and the downstream connector body section 40 remain connected to the main body section 20 by way of the USB cable 100. Thus, in the operational configuration, the upstream connector 300 is available for attachment to a Type A USB connector port, for example, on the host device, and the downstream connector 400 is available for attachment to the PED.

As shown in FIGS. 2-8, when the USB cable assembly 10 is in a storage configuration, the upstream and downstream connectors, 300 and 400, are secured in the upstream and downstream connector ports, 230 and 240, respectively. The upstream connector body section 30 and the downstream connector body section 40 mate with the main body section 20 to form a unified body with generally flat, smooth front and rear surfaces, and rounded corners and edges. The smooth, rounded contours of the USB cable assembly 10 allow a user to store the assembly 10 in garment pockets, for example, without snagging and tearing.

Figure 2:
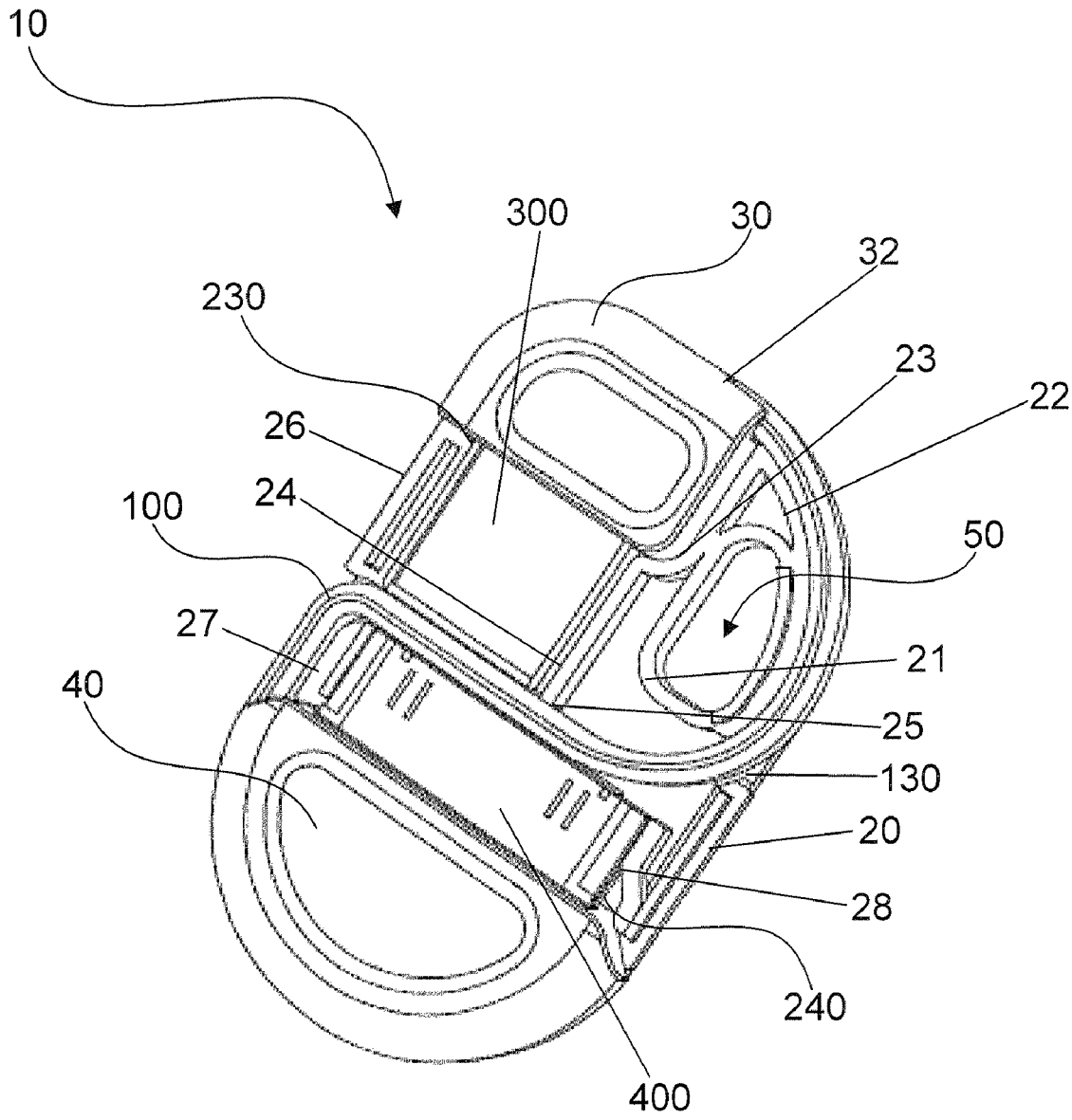
FIG. 2 is a top, cutaway view of the USB cable assembly shown in FIG. 1 in a second configuration, in accordance with aspects of the present invention.

As shown in the cutaway view of FIG. 2, the main body section 20 may be formed with an outer casing made of nonconductive material. The outer casing may be formed from a combination of two molded shells, for example, or any other method of forming a protected enclosure for securing and protecting the upstream connector 300, the downstream connector 400, and the USB cable 100 connecting the upstream connector 300 to the downstream connector 400. The main body section 20 may be generally hollow, for example, and formed with various features for providing structural support and positional guidance. For example, as shown in FIG. 2, a structural rib 21 surrounds a periphery of the through-hole 50 and provides structural support to an area of the assembly 10 that may be subjected to comparatively high levels of applied stress. In addition, along with an outer wall 22, the structural rib 21 may form an inner surface of a main body channel 130 that cradles an upstream portion of the USB cable 100 leading to the upstream connector 300 (see also FIGS. 3 and 5). Longitudinal rib 23 may be configured to form both a longitudinal and a lateral seat for positional mating of the upstream connector body section 30 in abutment with the main body section 20. A lower portion 24 of the longitudinal rib 23 may, in tandem with a securing wall 26, form the side walls of the connector port 230. In this manner, the lateral clearance between the lower portion of the longitudinal rib 23 and the securing wall 26 may be configured to ensure a secure fit of the upstream connector 300 when the upstream connector 300 is slidably received into the upstream connector port 230. A distal end 25 of the longitudinal rib 23 may be used as a positioning means along a transverse path of the USB cable 100 as the USB cable 100 passes through the main body section 20. A lower end wall 27 and a lower positional rib 28 form the side walls of the downstream connector port 240. As shown in FIG. 2, the lower positional rib 28 may be provided to exert a lateral pressure against the downstream connector 400 for securing the downstream connector 400 when inserted into the downstream connector port 240.

Figure 3:
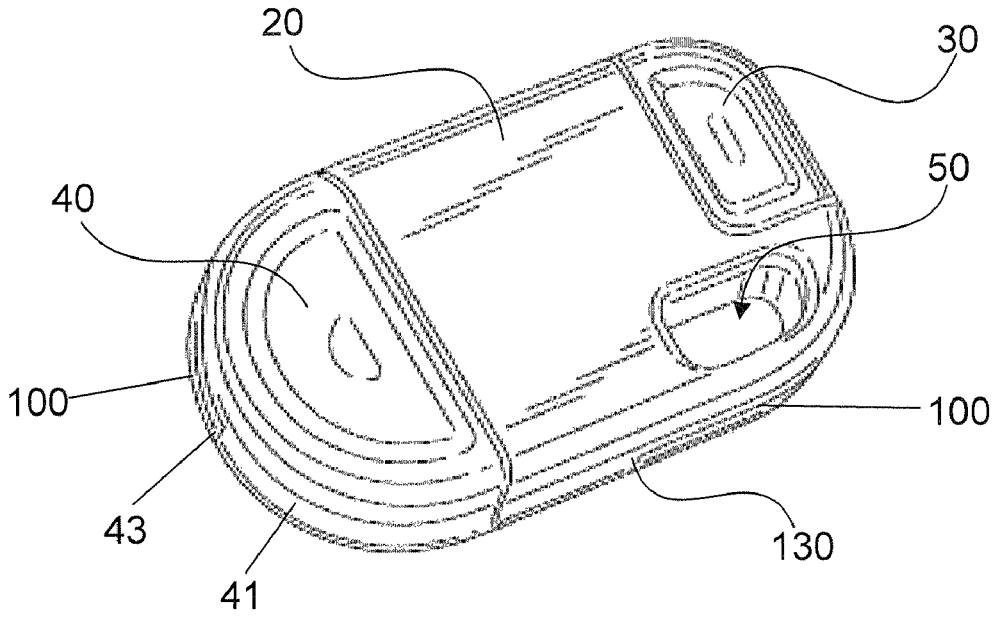
FIG. 3 is a perspective of the USB cable assembly shown in FIG. 2.
Figure 4:
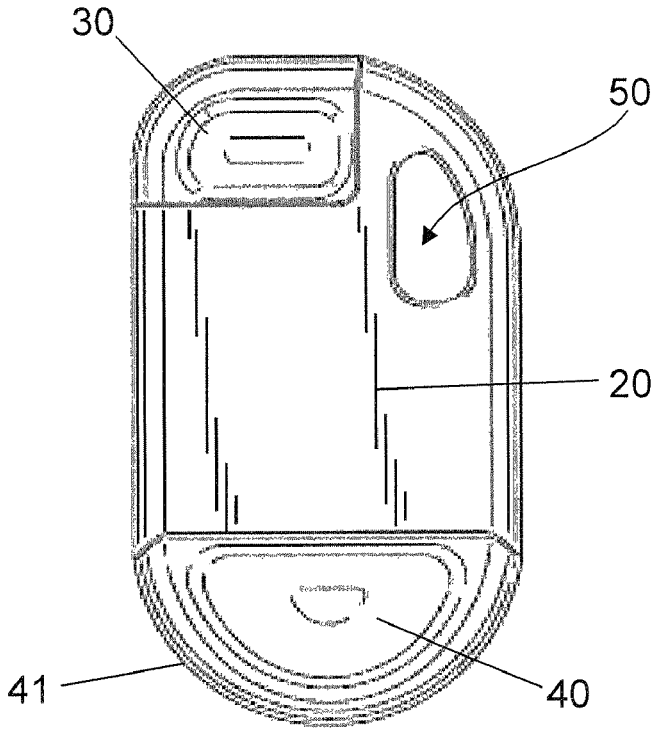
FIG. 4 is top view of the USB cable assembly shown in FIG. 2.

As shown in FIGS. 2-4, the upstream connector body section 30 may be formed as a parallelepiped with an outer casing made of nonconductive material formed from a combination of two molded shells, for example. The upstream connector body section 30 may be formed with rounded peripheral edges that align with the rounded peripheral edges of the main body section 20 when the upstream connector 300 is placed in a stored position, i.e., when fully inserted into the upstream connector port 230.

Figure 7:
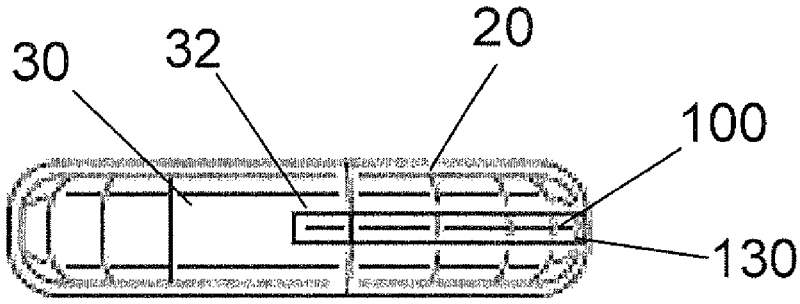
FIG. 7 is a top view of the USB cable assembly shown in FIG. 2.

When in the stored position, the upstream connector body section 30 mates with the main body section 20 in a position offset to one side of the longitudinal centerline of the USB cable assembly 10. As shown in FIGS. 2 and 7, an upstream cable passage 32 formed in a corner peripheral surface of the upstream connector body section 30 aligns with the main body channel 130 to cradle the upstream portion of the USB cable 100 along a periphery of the main body section 20. The upstream portion of the USB cable 100 enters the outer casing of the upstream connector body section 30 through the upstream cable passage 32 and is connected to the upstream connector 300. The upstream connector 300 is fixedly attached to the upstream connector body section 30 so that the upstream connector body section 30 houses and protects the USB cable 100 connection to the upstream connector 300.

As shown in FIGS. 1-4, the downstream connector body section 40 may be formed as a half-disc, for example, with an outer casing having a rounded semicircular edge 41 and a mating surface 42. The downstream portion of the USB cable 100 enters the outer casing of the downstream connector body section 40 through a downstream passage 43 and is connected to the downstream connector 400. A downstream body channel 45 may be formed in the semicircular edge 41 along a peripheral arc from where the USB cable 100 enters the downstream connector body section 40, at the downstream passage 43, to a lateral edge of the mating surface 42.

Figure 5:
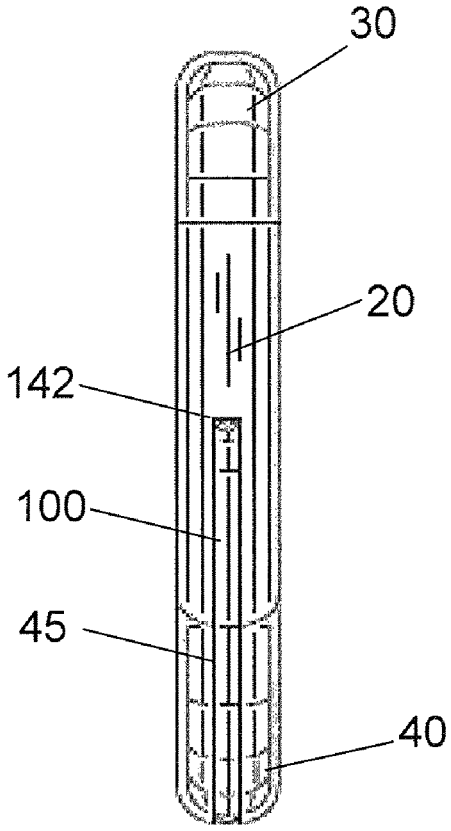
FIG. 5 is a left side view of the USB cable assembly shown in FIG. 2.
Figure 6:
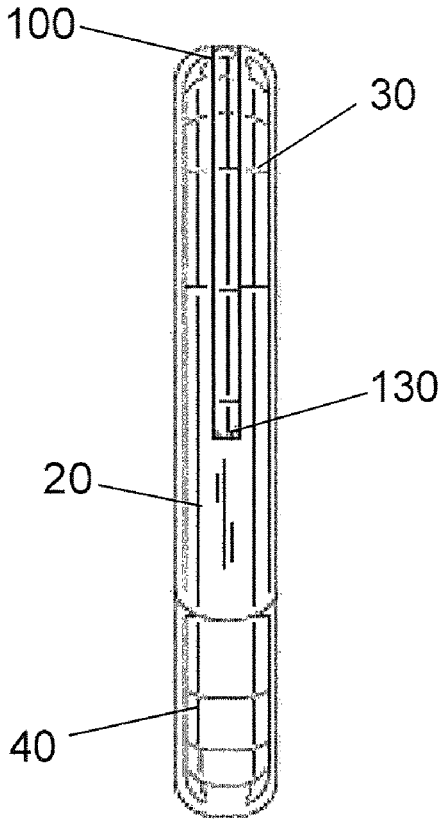
FIG. 6 is a right side view of the USB cable assembly shown in FIG. 2.
Figure 8:
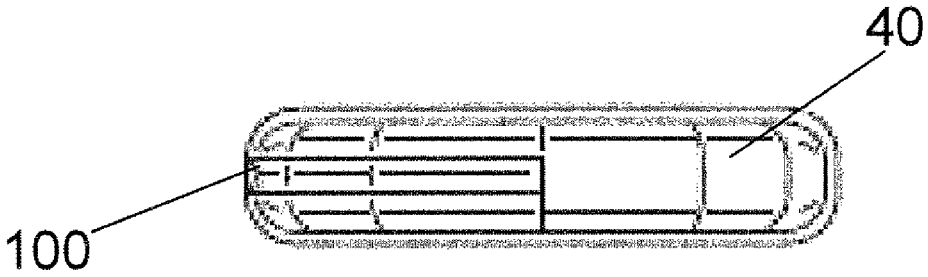
FIG. 8 is a bottom view of the USB cable assembly shown in FIG. 2.

When the downstream connector 400 is placed in the stored position, i.e., when fully inserted into the downstream connector port 240, the mating surface 42 of the main body section 20 abuts an end surface 29 of the downstream connector body section 40. As shown in FIGS. 1, 5 and 8, a cable passage 142 may be formed in a peripheral surface of the main body section 20. The cable passage 142 aligns with the downstream body channel 45 to cradle the downstream portion of the USB cable 100 along a periphery of the downstream connector body section 40. The downstream connector 400 is fixedly attached to the downstream connector body section 40 so that the downstream connector body section 40 houses and protects the USB cable 100 connection to the downstream connector 400.

In use, the USB cable assembly 10, which may be secured to a keychain, for example, is placed into the operational configuration by slidably removing the upstream and downstream connectors, 300 and 400, from the upstream and downstream connection ports 230 and 240. The unitary design of the cable assembly 10 ensures that the USB cable 100 remains slidably secured to the main body section 20 when the upstream and downstream connector body sections 30 and 40 are respectively disengaged. In this manner, all components of the cable assembly 10 remain continuously attached at all times, whether or not the cable assembly 10 is being used in an operational or storage configuration. Thus, a user will not misplace or lose a protective cap, for example, and can be assured that the critical components of the cable assembly 10 may always be stored in an efficient, protective manner, preventing damage and extending the effective life of the cable assembly 10 indefinitely.

In accordance with another aspect of the present invention, with the cable assembly 10 in an operational configuration, a distance that the upstream and downstream connectors, 300 and 400, can respectively extend away from the main body section 20 may be adjusted. For example, when initially disengaged from the main body section 20, the upstream connector body section 30 and the downstream connector body section 40 extend a predetermined distance from the main body section 20. Because the USB cable 100 is not fixed to the main body section 20, but slidably passes through the main body section 20, pulling on either of the upstream connector body section 30 or the downstream connector body section 40 will extend the respective body section 30 or 40 a distance from the main body section 20. The other of the upstream connector body section 30 or the downstream connector body section 40 will simultaneously retract the same distance toward the main body section 20 as the USB cable 100 is pulled through the main body section 20. The length that either of the upstream connector body section 30 or the downstream connector body section 40 can extend is limited only by the predetermined distance that the other of the upstream connector body section 30 or the downstream connector body section 40 initially extends from the main body section 20 upon disengagement from a stored configuration.

Once the cable assemble 10 is opened and configured as desired by the user, the upstream connector 300 may be connected to an appropriate port on the host device, and the downstream connector 400 connected to an appropriate port on the FED. The host may thus supply a predetermined current of power to the PED at 5V while simultaneously exchanging data with the PED in accordance with a specified USB standard, which may be USB 2.0 or USB 3.0, for example.

The USB cable assembly 10 may be placed in a storage configuration by inserting the upstream connector 300 into the upstream connector port 230 so that the upstream connector body section 30 seats flush with the main body section 20. The downstream connector 400 is inserted into the downstream connector port 240 so that the downstream connector body section 40 seats flush with the main body section 20. As shown in FIG. 2, when in the storage position, the upstream and downstream connectors, 300 and 400, occupy an upper and a lower space inside the main body section 20 and are separated substantially by a thickness of the USB cable 100. The upstream portion of the USB cable 100 may be pulled taut and secured into the main body channel 130, and the downstream portion of the USB cable 100 may be pulled taut and secured into the downstream body channel 45. The channels 130 and 45 effectively shield and protect the USB cable 100 from damage by preventing exposure to direct impacts and snags, for example. Due to the compact and efficient configuration of the USB cable assembly 10, as described above, the assembly is able to be lightweight, ergonomic and cost-efficient to manufacture while providing substantial protection to the critical components of the assembly.

Figure 9:
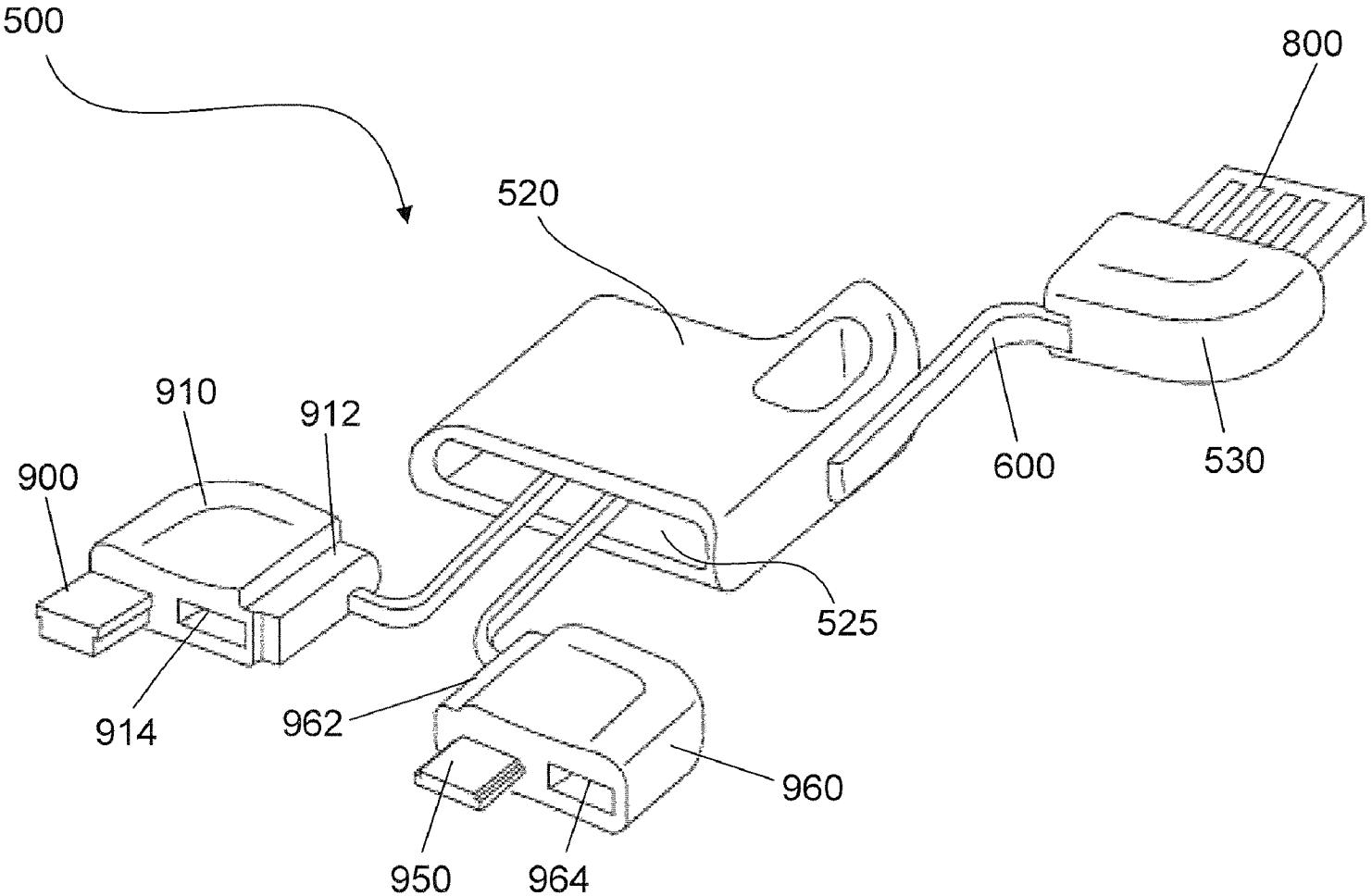
FIG. 9 is a perspective view of a USB cable assembly in a first configuration, in accordance with aspects of the present invention.

FIGS. 9-14 show another variation of a USB cable assembly 500, in accordance with aspects of the present invention, in which the USB cable assembly 500 may be provided with multiple downstream connectors, such as dual mini and micro USB connectors. As shown in FIG. 9, the USB cable assembly 500 shares similar aspects with respect to the upstream side of the USB cable assembly 10, including a Type-A upstream connector 800, and a main body section 520 provided with an upstream connector port 730 for receiving the upstream connector 800 and a keychain loop 550. The downstream side of the USB cable assembly 500, as depicted in FIG. 9, has a first downstream connector 900, which may be a mini-A or mini-B type USB connector, and a second downstream connector 950, which may be a micro-A or micro-B type USB connector. The first and second downstream connectors, 900 and 950, may secure to and extend from first and second housings 910 and 960, respectively. The first housing 910 may be formed with a first main body insertion step 912 and a second connector housing port 914, and the second housing 960 may be formed with a second main body insertion step 962 and a first connector housing port 964. To place the USB cable assembly 500 into a storage configuration, the first downstream connector 900 is slidably received into the first connector housing port 964 in the second housing 960, and, simultaneously, the second downstream connector 900 is slidably received into the second connector housing port 914 in the first housing 910. Accordingly, the first housing 910 serves as a mechanism for protecting the second downstream connector 950 mounted to the second housing 910, and the second housing 960 serves as a mechanism for protecting the first downstream connector 900 mounted to the second housing 960. With the housings 910 and 960 effectively joined into a combined housing unit, the first and second main body insertion steps, 912 and 962, present a unified, lateral insertion step that is contoured in order to be press fit, for example, into a main body downstream port 525.

Figure 10:
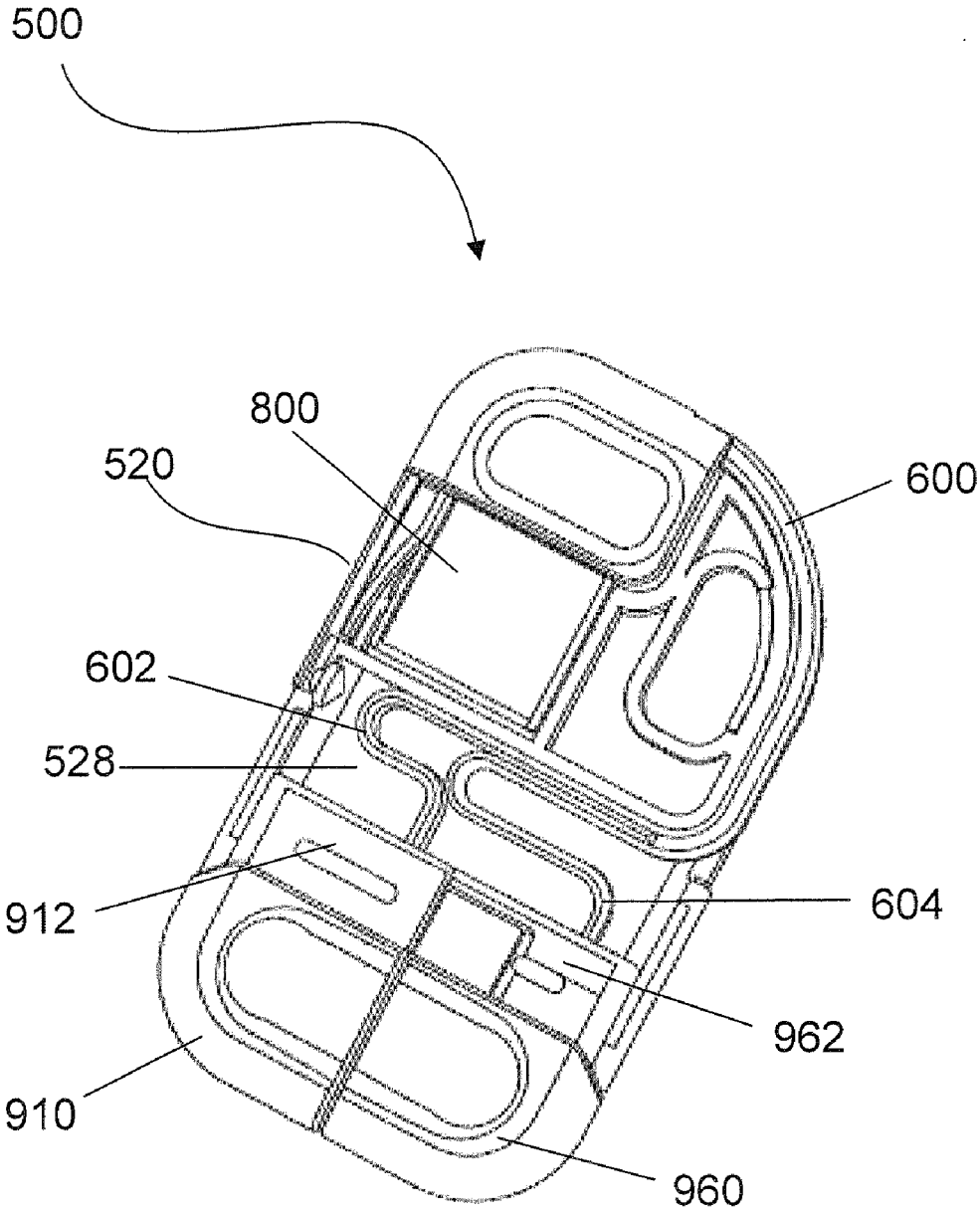
FIG. 10 is a top, cutaway view of the USB cable assembly shown in FIG. 9 in a second configuration, in accordance with aspects of the present invention.
Figure 11:
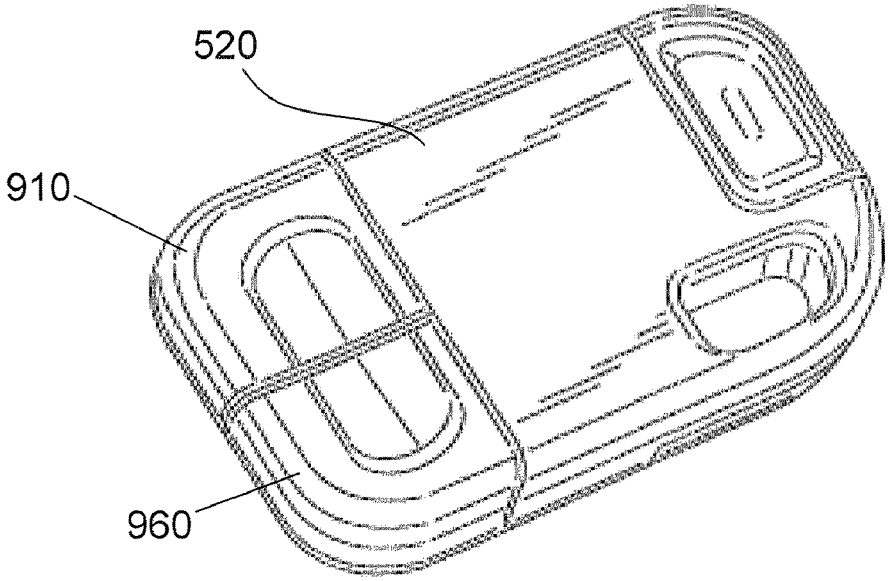
FIG. 11 is a perspective of the USB cable assembly shown in FIG. 10.
Figure 12:
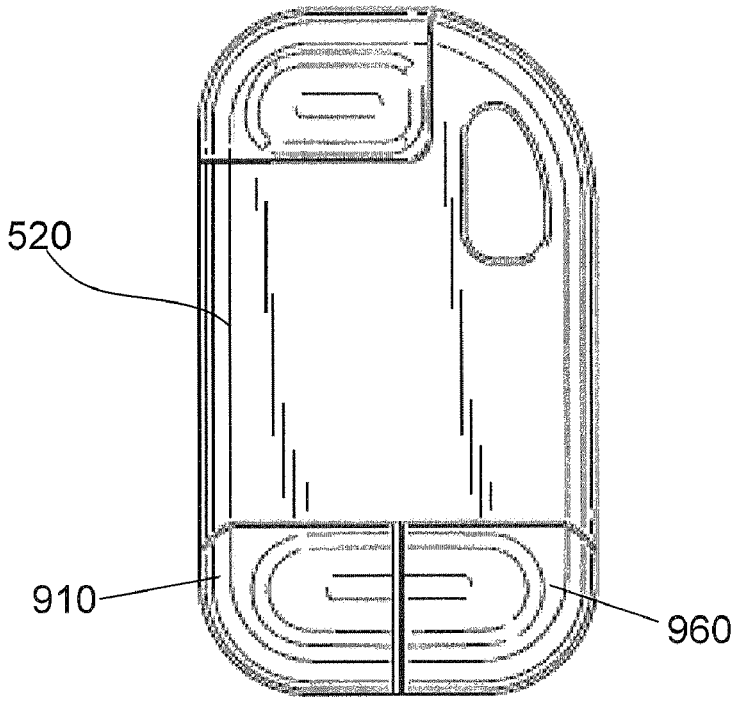
FIG. 12 is top view of the USB cable assembly shown in FIG. 10.
Figure 13:
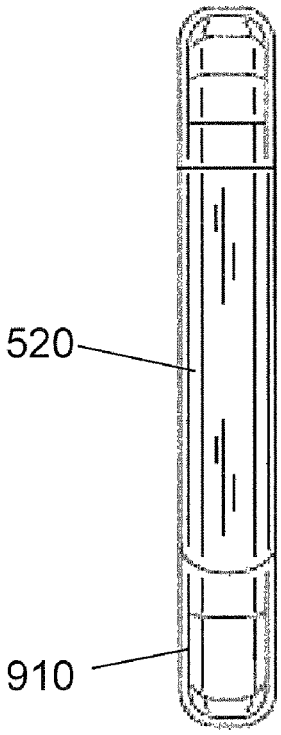
FIG. 13 is a left side view of the USB cable assembly shown in FIG. 10.
Figure 14:
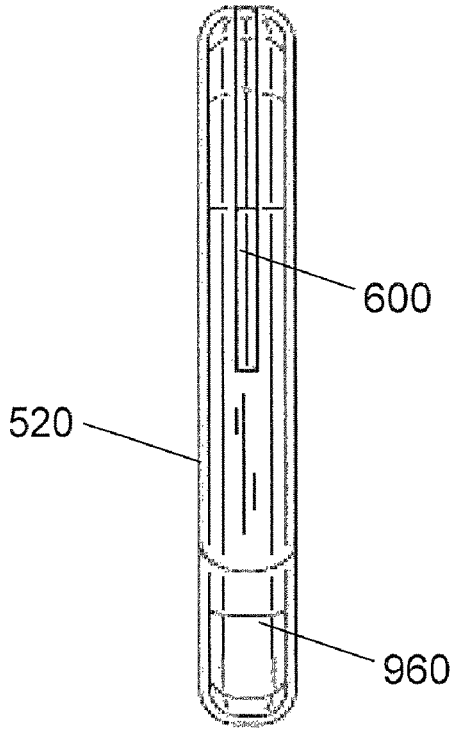
FIG. 14 is a right side view of the USB cable assembly shown in FIG. 10.

As shown in FIG. 10, the USB cable 600 may be split into first and second downstream cables, 602 and 604, respectively, to provide a connection from the upstream connector 800 to the first and second downstream connectors, 900 and 950. The main body section 520 has an interior chamber 528 for storing and protecting the cables, 602 and 604, when the USB cable assembly 500 is placed into a storage configuration. As shown in FIGS. 9 and 10, the USB cables 602 and 604 extend from the respective first and second main body insertion steps 912 and 962. In this manner, when the first and second housings 910 and 960 are joined, with the first and second downstream connectors 900 and 950 inserted into each of the first and second downstream connector housing ports 914 and 916, the cables 602 and 604 extend from the housings 910 and 960 toward the main body downstream port 525. Thus, as shown in FIG. 10, when the USB cable assembly 500 is placed into the storage configuration, the cables 602 and 604 are forced into the interior chamber 528. FIGS. 11-14 provide further illustrations of the USB cable assembly 500 in which the cables 602 and 604 are entirely contained internal to the assembly in a storage configuration.

The unitary design of the cable assembly 500 ensures that the USB cable 600 remains secured to the main body section 520 when the upstream connector 800 and both downstream connectors 900 and 950 are respectively disengaged. In this manner, all components of the cable assembly 500 remain continuously attached at all times, whether or not the cable assembly 500 is being used in an operational or storage configuration. Thus, a user will not misplace or lose a protective cap, for example, and can be assured that the critical components of the cable assembly 500 may always be stored in an efficient, protective manner, preventing damage and extending the effective life of the cable assembly 500 indefinitely.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but is to be accorded the full scope consistent with the language claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A Universal Serial Bus (USB) cable assembly for connecting a portable electronic device to a host device, comprising:

a USB cable;

an upstream connector;

a downstream connector connected to the upstream connector by the USB cable; and a main body section having an upstream connector port configured to slidably receive the upstream connector and a downstream connector port configured to slidably receive the downstream connector, wherein the USB cable is slidably secured to the main body section.

2. The USB cable assembly of claim 1, wherein the upstream connector is a male 4 pin Type A USB connector.

3. The USB cable assembly of claim 1, wherein the downstream connector is a 30 pin dock connector.

4. The USB cable assembly of claim 1, wherein the USB cable delivers power from the host device to the portable electronic device at a voltage of 5V.

5. The USB cable assembly of claim 1, wherein the main body section further comprises an attachment mechanism.

6. The USB cable assembly of claim 5, wherein the attachment mechanism is a through-hole formed in the main body section.

7. The USB cable assembly of claim 1, wherein the main body section further comprises a main body channel for securing the USB cable to a peripheral surface of the main body section when the upstream connector is slidably inserted into the upstream connector port.

8. The USB cable assembly of claim 1, further comprising a downstream connector body section, wherein the downstream connector is mounted to the downstream connector body section, and wherein the USB cable connects to the downstream connector at a point interior to the downstream connector body section.

9. The USB cable assembly of claim 8, wherein the downstream connector body section further comprises a downstream body channel for securing the USB cable to a peripheral surface of the downstream connector body section when the downstream connector is slidably inserted into the downstream connector port.

10. The USB cable assembly of claim 8, further comprising an upstream connector body section, wherein the upstream connector is mounted to the upstream connector body section, and wherein the USB cable connects to the upstream connector at a point interior to the upstream connector body section.

11. The USB cable assembly of claim 10, wherein the upstream connector body section abuts the main body section in a position offset to one side of a longitudinal centerline of the USB cable assembly when the upstream connector is slidably inserted into the upstream connector port.

12. The USB cable assembly of claim 1, wherein one of the upstream connector and the downstream connector extends further away from the main body section when the USB cable is pulled through the main body section.

13. A USB cable assembly for connecting a portable electronic device to a host device, comprising:

an upstream connector section comprising:

a housing; and an upstream connector secured to the housing;

a downstream connector section comprising:

a first downstream housing;

a first downstream connector secured to the first downstream housing;

a second downstream housing; and a second downstream connector secured to the second downstream housing;

a main body section comprising:

an upstream connector port configured to slidably receive the upstream connector; and a downstream port configured to slidably receive the first and second downstream housings; and a USB cable, wherein the upstream connector section, the main body section and the downstream connector section are joined together by the USB cable.

14. The USB cable assembly of claim 13, wherein the first downstream housing further comprises a second connector housing port for slidably receiving the second connector, and wherein the second downstream housing further comprises a first connector housing port for slidably receiving the first connector.

15. The USB cable assembly of claim 14, wherein the first downstream housing further comprises a first main body insertion step and the second downstream housing further comprises a second main body insertion step, and wherein the first and second main body insertion steps form a unified lateral insertion step when the first connector is inserted into the first connector housing port and the second connector is simultaneously inserted into the second connector housing port.

16. The USB cable assembly of claim 14, wherein the main body section further comprises a main body downstream port for slidably receiving the unified lateral insertion step.

17. The USB cable assembly of claim 13, wherein the first downstream connector is one of a Mini-A and a Mini-B type USB connector.

18. The USB cable assembly of claim 13, wherein the second downstream connector is one of a Micro-A and a Micro-B type USB connector.

19. The USB cable assembly of claim 13, wherein the main body section further comprises an attachment mechanism.

20. The USB cable assembly of claim 19, wherein the attachment mechanism is a through-hole formed in the main body section.

21. The USB cable assembly of claim 13, wherein the main body section further comprises a main body channel for securing the USB cable to a peripheral surface of the main body section when the upstream connector is slidably inserted into the upstream connector port.

22. The USB cable assembly of claim 16, wherein the USB cable extends from the upstream connector and splits into a first downstream USB cable and a second downstream USB cable to connect the upstream connector to the first and second downstream connectors.

23. The USB cable assembly of claim 22, wherein the main body section further comprises an interior chamber, and wherein the first and second downstream USB cables are positioned in the interior chamber when the main body downstream port slidably receives the unified lateral insertion step.

* * * * *